US007703811B2

(12) United States Patent
Isherwood

(10) Patent No.: US 7,703,811 B2
(45) Date of Patent: Apr. 27, 2010

(54) SECURITY THREAD

(75) Inventor: Roland Isherwood, Whitchurch (GB)

(73) Assignee: De La Rue International, Ltd., Hampshire (GB)

( * ) Notice: Subject to any disclaimer, the term of this patent is extended or adjusted under 35 U.S.C. 154(b) by 1080 days.

(21) Appl. No.: 10/541,679

(22) PCT Filed: Jan. 9, 2004

(86) PCT No.: PCT/GB2004/000077

§ 371 (c)(1),
(2), (4) Date: Aug. 8, 2005

(87) PCT Pub. No.: WO2004/062943

PCT Pub. Date: Jul. 29, 2004

(65) Prior Publication Data

US 2006/0097512 A1 May 11, 2006

(30) Foreign Application Priority Data

Jan. 10, 2003 (GB) ..... 0300599.8

(51) Int. Cl.
*B42D 15/00* (2006.01)
*B42D 15/10* (2006.01)
*H01F 1/00* (2006.01)

(52) U.S. Cl. ..... 283/82; 283/72; 283/83; 283/86; 283/91; 283/117; 283/901; 427/548; 427/555

(58) Field of Classification Search ..... 160/140; 283/72, 82, 83, 86, 91, 100; 427/131, 282, 427/286, 376.6, 383.1, 511, 548, 555; 428/208, 428/209, 915, 916; 430/1, 2; *B41M 3/14; B42D 15/00*
See application file for complete search history.

(56) References Cited

U.S. PATENT DOCUMENTS

| | | | | |
|---|---|---|---|---|
| 4,652,015 | A | 3/1987 | Crane | |
| 4,941,687 | A | 7/1990 | Crane | |
| 4,943,093 | A * | 7/1990 | Melling et al. | 283/83 |
| 5,354,099 | A | 10/1994 | Kaule et al. | |
| 5,688,587 | A | 11/1997 | Burchard et al. | |
| 6,127,034 | A | 10/2000 | Chorley | |
| 6,199,911 | B1 | 3/2001 | Isherwood et al. | |
| 6,343,745 | B1 | 2/2002 | Bohm et al. | |
| 2002/0090556 | A1 * | 7/2002 | Jotcham et al. | 430/1 |

FOREIGN PATENT DOCUMENTS

| | | |
|---|---|---|
| EP | 0279880 | 8/1988 |
| EP | 0407550 | 10/1994 |

* cited by examiner

*Primary Examiner*—Dana Ross
*Assistant Examiner*—Justin V Lewis
(74) *Attorney, Agent, or Firm*—Dykema Gossett PLLC

(57) ABSTRACT

The current invention relates to a security element for security substrates, such as those used for banknotes and the like, having enhanced public recognition, anti-counterfeit and detection properties. A security element comprising an elongate strip of a light transmitting polymeric substrate, said substrate being provided with a magnetic feature and a metallic design, the metallic design being provided by a combination of metal and non-metallic regions and comprising indicia, characters, patterns, designs, or geometrical shapes or a combination of the aforesaid design comprising at least one repeating pattern or which one or more of the frequency, the instantaneous amplitude and/or the maximum amplitude of the pattern varies along the length of the element, said pattern being positioned relative to the magnetic feature such that it does not overlap therewith.

29 Claims, 9 Drawing Sheets

SECURITY THREAD

BACKGROUND OF THE INVENTION

1. Field of the Invention

The current invention relates to a security element for security substrates, such as those used for banknotes and the like, having enhanced public recognition, anti-counterfeit and detection properties.

2. The Prior Art

It is widely known to include security elements, such as security threads or strips, into security documents to protect against forgery. Typically these elements comprise a polymer carrier to which a metal layer is applied, though they may also have additional functional layers such as magnetic, thermochromic or luminescent layers.

Security elements of this type have the advantage that they can be verified both visually and by machine. However, there is a constant need to improve the security of these devices in order to remain one step ahead of the counterfeiters. Developments have included improving the public recognition, machine readable, and anti-counterfeit properties.

Public recognition or visually identifiable features have been known for some time and include security elements with microprint; metallic indicia on a transparent element (such as are disclosed in EP-A-279880, U.S. Pat. No. 4,941,017 & U.S. Pat. No. 4,652,015) and metallic security elements with transparent indicia (such as are disclosed in EP-A-0319157). The latter security elements, supplied by the De La Rue Group, are known by the trade mark Cleartext®, and are utilised in a number of the world's major currencies. Cleartext® security elements have proved to be highly successful due the ease with which the public can verify them without the need for additional aids or equipment. A variant of the Cleartext® type of security element is described in EP-A-659587, in which the security elements are provided with demetallised characters of varying heights.

The principles behind Cleartext® and this type of security element have been further improved by enhancing both the anti-counterfeit and aesthetic properties as described in EP-A-972111. In this specification the security element design comprises at least one repeating geometric pattern of which one of more of the frequency, instantaneous amplitude and/or maximum amplitude of the pattern varies along the length of the element and design having at least one non-linear boundary. Such designs are much harder to counterfeit and consequently more secure. They also have the additional benefit of being highly aesthetic and can be designed in such a way as to co-ordinate with other design features on a document.

It has also been recognised that there is an increasing need to be able to identify and characterise security documents automatically by machine. This can be achieved by the provision of additional functional layers to security elements as described earlier. It is particularly common to make use of magnetic layers and, more recently, coded magnetic layers. One such coded security element is described in EP-A-0407550. Here the code is provided in the form of a machine-readable binary code in the magnetic layer. The code consists of alternating 'termination' and 'word' segments, which are made up of blocks or 'bits' of magnetic coating. Each word segment has the same length, with the presence of magnetic material in a bit denoting a '1', and the absence of magnetic material a '0'. This thread allows for unique identification of the security elements but is not intended as a publicly verifiable feature.

The need to combine the benefits of a machine readable layer and the public recognition properties of Cleartext® has been recognised and EP-A-0516790 describes a security element comprising a transparent carrier material, a metallic layer with gaps and a magnetic layer disposed above or below the metal layer. The gaps take the form of characters, patterns or other indicia and are located in those areas where no magnetic layer is present, thus ensuring that the negative writing on the thread is readable in transmitted light. The security elements may have an additional magnetic layer, electro-conductive material added to the magnetic layer or magnetic material added to the metallic layer, providing a form of 'coding'. This security element has the advantage that it combines an easily recognisable feature with a machine-verifiable one.

EP-A-0961996 and EP-A-0938417 disclose further improved security elements comprising a plastic layer, an opaque layer with gaps and a magnetic layer. In common with the security elements described in EP-A-0516790 the gaps are positioned in those areas where no magnetic layer is present so they are visible in transmitted light, but the magnetic layer is additionally periodically spaced with non-magnetic areas to form a coding. The coding may take the form of the codes described in EP-A-0407550, or may be of a different type. Though both EP-A-0516790 and EP-A-0961996 do provide both public and machine-readable properties the current invention seeks to further improve on the machine readable, public recognition and anti-counterfeit properties.

SUMMARY OF THE INVENTION

According to the Invention there is therefore provided a security element comprising an elongate strip of a light transmitting polymeric substrate, said substrate being provided with a magnetic feature and a metallic design, the metallic design being provided by a combination of metal and non-metallic regions and comprising indicia, characters, patterns, designs, or geometrical shapes or a combination of the aforesaid design comprising at least one repeating pattern of which one or more of the frequency, the instantaneous amplitude and/or the maximum amplitude of the pattern varies along the length of the element, said pattern being positioned relative to the magnetic feature such that it does not overlap therewith.

Key to the current invention is the recognition that the primary level of authentication in the majority of cases is by public inspection. Though the inventors recognise that machine inspection is typically of paramount importance when authenticating a document, this may only occur a limited number of times during the life of a document. In some instances this may only be twice, just prior to issuance by a central bank and upon return to a central bank. A far more regular occurrence is the need for the public to rapidly authenticate a document either with or without any additional aids. The inventors have recognised that in both EP-A-0516790 and EP-A-0961996 the visual aspects of the security element have been compromised in order to accommodate the magnetic and machine-readable aspects. Examples in both patent specifications show the demetallised, public recognition, region constrained in order to allow for the magnetic features.

Within the current invention it is the visual features that take precedence and the magnetic features, which are secondary. It is also the intention of the current invention to allow for the incorporation of more complex design elements such as those described within EP-A-972111 thus enhancing the anti-counterfeit properties of the security element. As indicated previously structures of the type described in EP-A-972111 can also be used in such a way as to enhance the public recognition properties by carrying design themes through from the document into the security element's design. This is particularly the case where wider security elements are used. The design theme may mirror a guilloche, medallion or white line pattern printed on the document or be a representation of a watermark image within the paper alternatively some other design feature may be used.

It has also been found that security elements produced according to the current invention can be read using the installed base of magnetic thread detectors. Thus retaining the current need to read security elements by machine. In addition the distribution of magnetic ink printed on the security elements can be utilised as a unique identifier, though this may require some enhancements to the detection equipment.

The security element has enhanced security over known security elements due to a combination of a complex visual design, that is difficult to forge, and machine-verifiable features. This is achieved by designing the magnetic layer around the visual design, rather than accommodating the design to the magnetic layer as in the prior art elements described in EP-A-0961996 and EP-A-0516790. The current invention is equally applicable for security elements having either positive or negative demetallisation as illustrated in the figures.

As indicated earlier the need for secure publicly recognisable security features is of paramount importance for banknotes and other documents of value. Cleartext® and similar security elements are now present in many of the world's major currencies and consequently the public is very familiar with the feature. The current invention makes use of the familiar, public recognition, aspects of Cleartext®, but further enhances the security against counterfeiting.

The prior art to date has focused on providing a machine-readable variant of the Cleartext® type of security element in both uncoded and coded forms. Whereas these provide improved machine readability for use by central banks they do not enhance the security of the device for the general public. The current invention recognises that provision of a machine-readable security element is important but of greater importance is the need to provide a high degree of public security. The improved public security could not be provided by the security elements described in the prior art as the visually features are constrained by the distribution of the magnetic material. To appreciate the value of the current invention it is important to understand how a counterfeit banknote gets passed. When producing a counterfeit note the primary concern for the majority of counterfeiters is passing the note in a shop or retailer. Generally a counterfeiter is not concerned with providing a counterfeit that can be machine verified by a commercial or central bank. To this end there is little need for a counterfeiter to reproduce the machine readable features such as the magnetics on the security elements/threads. To replicate the magnetic features would be difficult, expensive, and provide no additional benefit to the counterfeiter when trying to pass a note in a shop. Retailers when accepting notes generally rely on how a note looks and how a note feels. One key aspect of how a note looks are the embedded security features such as threads and watermarks. In order to pass a counterfeit note a counterfeiter will go to great lengths to replicate threads and watermarks using a number of techniques such as printing and foil blocking. It is therefore of great importance that features such as threads are made as hard as possible to replicate by counterfeiters and thus remain valued as public recognition features. The current invention has been developed with a view to retaining the machine-readable features of use to central banks but also further improving the public security aspects of demetallised Cleartext® type threads.

However as a further additional benefit it has been found that the security of the machine readable aspect of the security element is also improved as a consequence of the improved public security. A disadvantage of both EP-A-516790 and EP-A-961996 is they both result in clearly distinct areas of plain metal with no demetallisation present. Implementations of both patents result in either tramlines along either edge or blocks of metal along the length of the security element. In either implementation these areas are clearly distinct from the demetallised design regions draw attention to the fact that something else may be present. This in turn encourages would be counterfeiters to investigate and identify the presence of the magnetic material. The counterfeiter may then take steps to replicate the magnetic feature as well as the demetallised design. This would be not be a trivial step for the counterfeiter but if achieved could seriously undermine the security of the document. It is preferable that attention is not drawn to such features so no attempt is made to replicate them. In the current invention the demetallised design takes precedence over the magnetic features, so less attention is drawn to the regions where no demetallisation is present. Consequently the attention of a would be counterfeiter is not drawn to the wholly metallised regions and the need to investigate whether they are masking additional features. As indicated above it is unlikely the majority of counterfeiters would wish to try and replicate the magnetic feature but by drawing their attention to it you increase the risk of an attempt being made. The current invention reduces the risk of this occurrence by not drawing the counterfeiters' attention to the magnetic feature.

As a further surprising benefit of the present invention it has been found that using different size and shape magnetic areas to accommodate the demetallised regions creates a unique identifier for a security element. Thus the security element may have a binary code dictated by 'word' and 'termination' segments as disclosed in EP-A-0407550, and a secondary more complex code dictated by the intensity and distribution of the segments. It has also been found that the thickness of the magnetic layer applied influences the magnetic reading, so that a thicker layer results in a machine-readable increase in magnetic intensity. Thus applying a thicker layer of magnetic ink to predetermined word and termination segments may enhance the secondary code.

A further advantage in the current invention lies in the potential for the security element to also be authenticated at a teller assist level. A teller is provided with a magnetic viewer, such as those sold by Sigma Hi-Chemical Inc under the trade name MV-95. This can be placed on the security element to reveal the presence of a magnetic feature. In this instance the magnetic feature can be provided in such a way as to complement the visible feature and as such when viewed through the magnetic viewer is instantly recognisable. Thus enabling the teller to rapidly verify that the security element and therefore document is genuine.

The invention will now be described, by way of example only, with reference to the accompanying drawings.

DETAILED DESCRIPTION OF THE PREFERRED EMBODIMENTS

The present invention provides a security element 10 for incorporation in or on a substrate, such as paper to form a security substrate.

Figure 1:
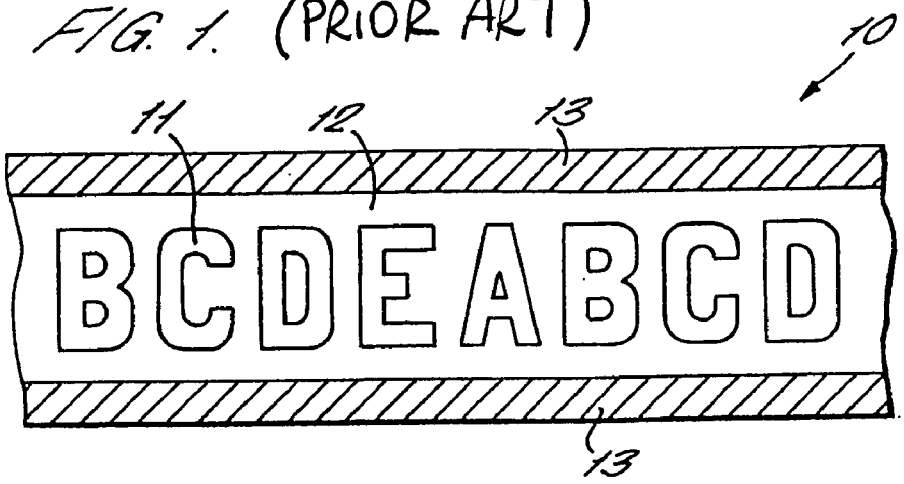
FIG. 1. (PRIOR ART)
FIGS. 1, 2 and 3 are plan views of sections of security elements known in the prior art.
Figure 2:
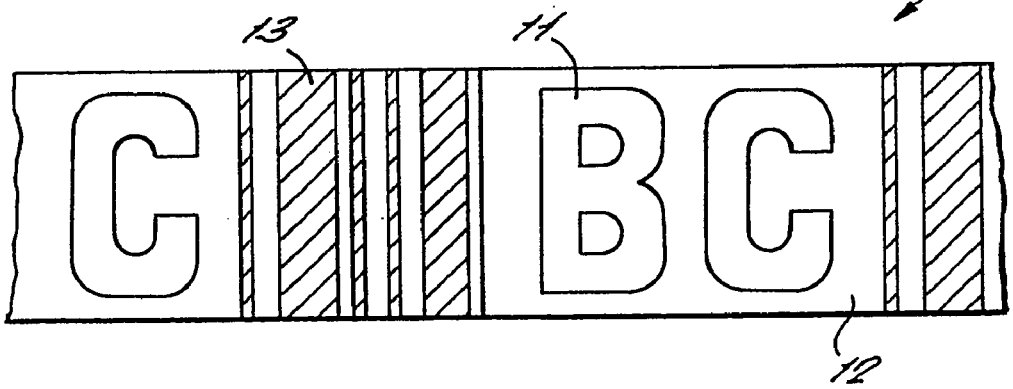
FIG. 2. (PRIOR ART)
Figure 3:
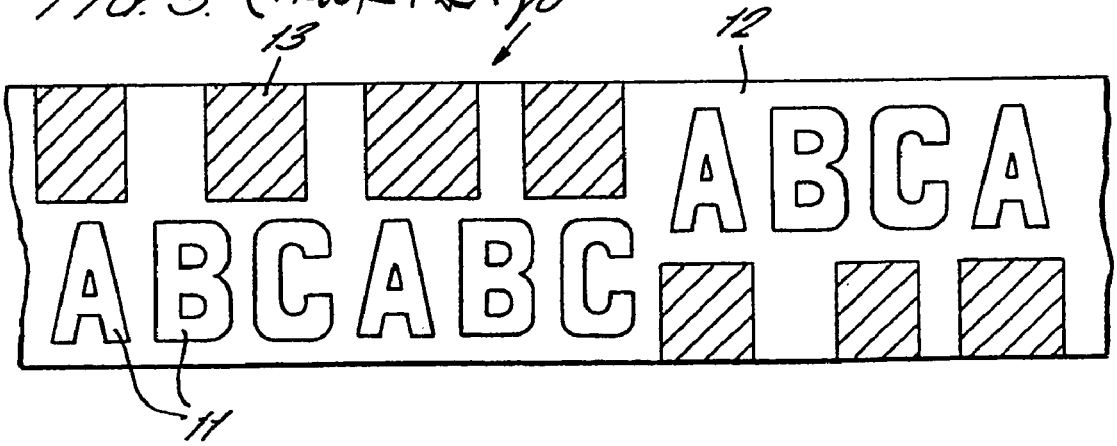
FIG. 3. (PRIOR ART)

FIGS. 1, 2 and 3 illustrate security elements 10 known in the prior art. In each case it can clearly be seen that the visual design features, formed by demetallised regions 11 in a metal layer 12, have been constrained in order to accommodate the need for a magnetic feature 13. In FIG. 1 the magnetic feature comprises tram lines along each edge of the security element and in FIGS. 2 and 3 they comprise magnetic bit sequences. Although the magnetic regions are shown in each of these figures, it should be appreciated that they will not be visible as the opaque metal layer 12 extends to mask them. Such constructions have been utilised and are currently present in some currencies. The construction does provide limitations on the range of demetallised designs that can be used and does compromise the aesthetic quality of the security element even when embedded into paper.

The security element 10 according to the present invention is manufactured according to methods known to those skilled in the art, for example in accordance with the teaching of EP-A-0961996 or EP-A-0516790. The security element 10 preferably comprises a transparent plastic substrate to at least one side of which a magnetic material, forming the magnetic feature 13, is applied. In one embodiment a metallic layer 12 is then applied over the substrate, covering the magnetic material, by a suitable method such as vacuum deposition. The metallic layer 12 is provided with demetallised gaps or regions 11 using a heat-softening or vaporable inks, for example by the method described in EP-A-0330733 or EP-A-0516790 or by any of the other known methods such as resist and etch. The substrate is slit to form individual security elements 10, having a width preferably between 0.8 mm-30 mm.

Figure 4:
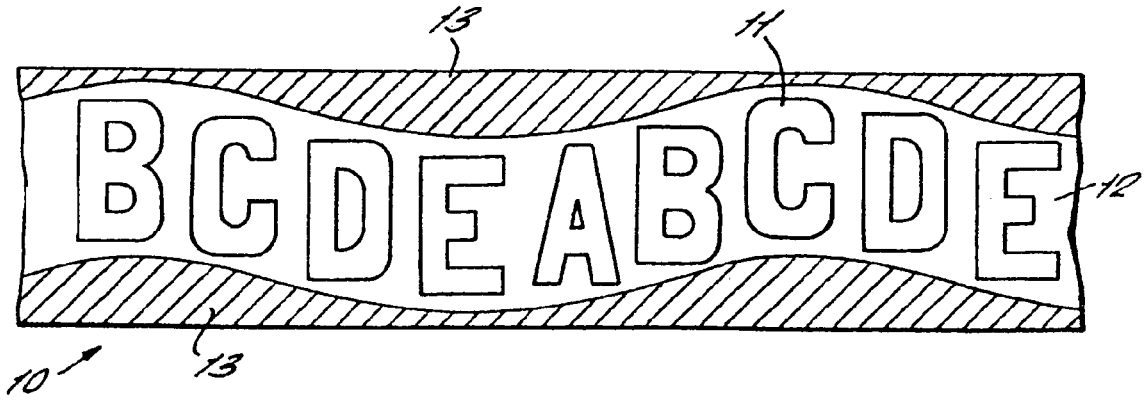
FIGS. 4, 4*a* and 5-15 are plan views of sections of different embodiments of security elements according to the present invention.

The security element 10 is then inserted into paper, for example on a cylinder mould machine, so that it is either wholly or partially embedded within the paper fibres. The method by which the security element is embedded could be any one of at least the methods described in EP-A-0070172, EP-A-0059056, EP-A-860298 or EP-A-0229654. FIG. 4 illustrates a security element 10 manufactured according to the current invention. The security element 10 is provided with a design formed by the demetallised regions 11 in the metal layer 12 which, in this embodiment, is in form of text along its length. To provide one of the necessary secure features of the security element 10 of the present invention, the design must incorporate a repeating pattern, of which one or more of the frequency, the instantaneous amplitude and/or the maximum amplitude of the pattern varies along the length of the element 10. The position, ie the instantaneous amplitude, of the demetallised indicia thus varies constantly and repeatedly about a centre line along the length of the security element 10, which variation in position increases the visual impact of the indicia text and the anticounterfeitability of the element 10. Beneath the metal layer 12, the magnetic material is printed along both edges of the security element 10 to form the magnetic feature 13, such that it does not overlap with the pattern (provided by the demetallised regions 11) and thus, in this embodiment, the height of the magnetic feature 13 varies. The height variation along either edge of the element 10 is such that the amount of magnetic material present in any cross section of the element 10 is constant.

Figure 5:
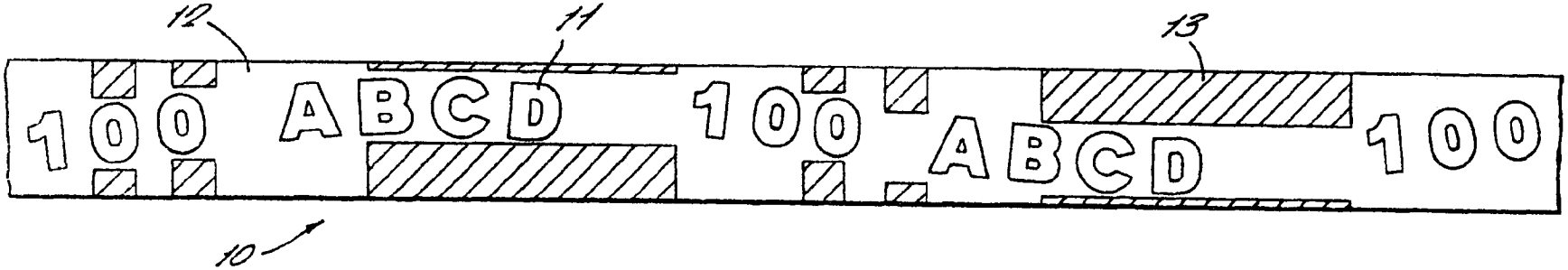

The magnetic feature 13 may alternatively comprise bit segments, as described in EP-A-0407550, and as illustrated in FIG. 5.

Figure 6:
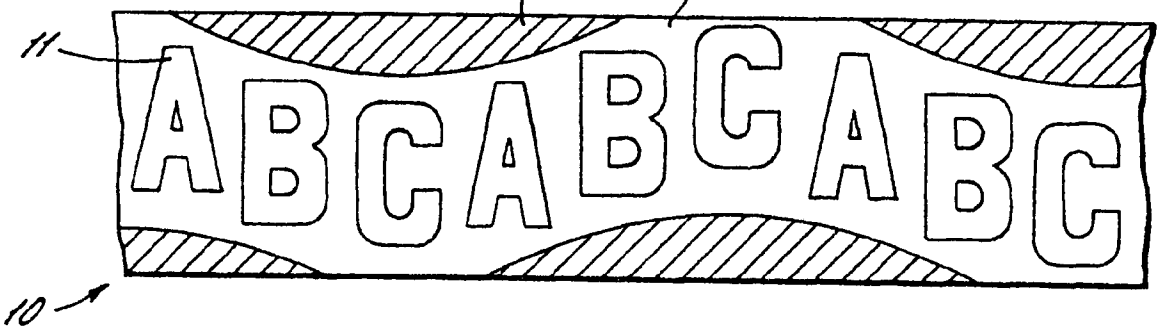
Figure 7:
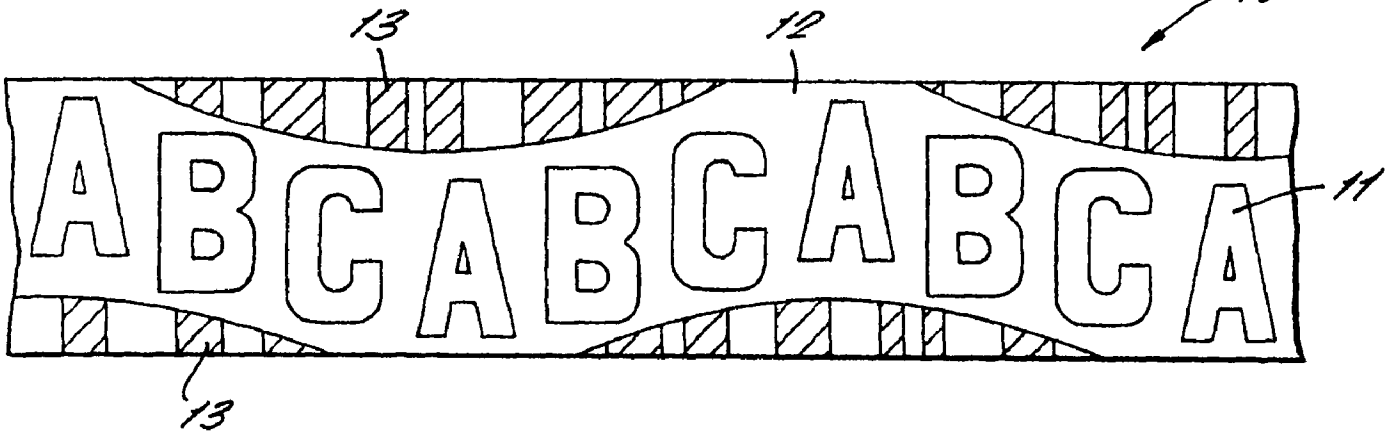

As an alternative the magnetic material may be provided in a discontinuous manner along the top and bottom edges as shown in FIG. 6. Again even though the magnetic material is discontinuous along each edge the amount of magnetic material present in a cross section of the security element remains constant. A similar principle applies when the magnetic material is printed to provide a feature 13 of a coded format as shown in FIGS. 5 and 7. Here the amount of magnetic material relating to a particular bit segment will remain the same, be it printed along one edge or partially printed along both edges.

Figure 8:
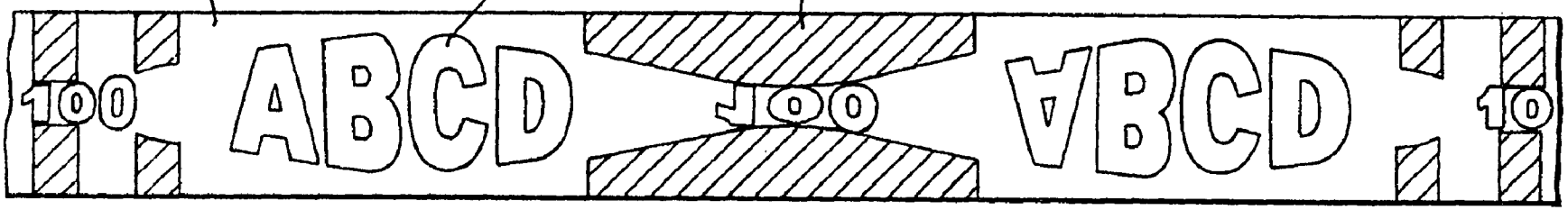
Figure 9:
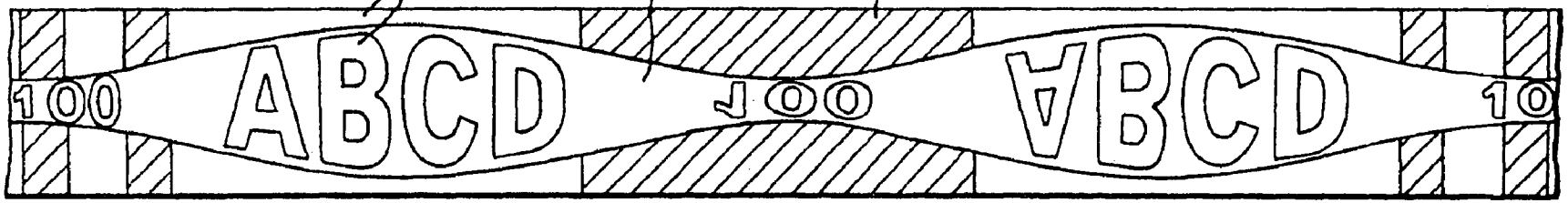
Figure 10:
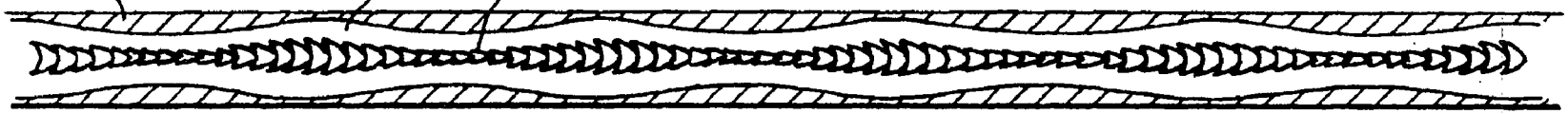
Figure 11:
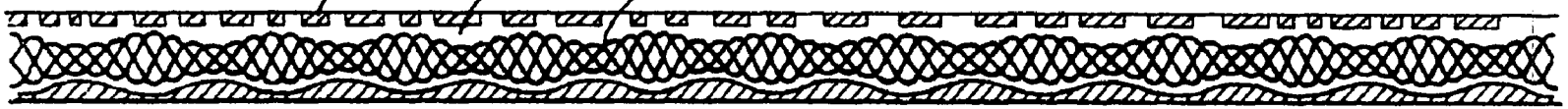
Figure 12:
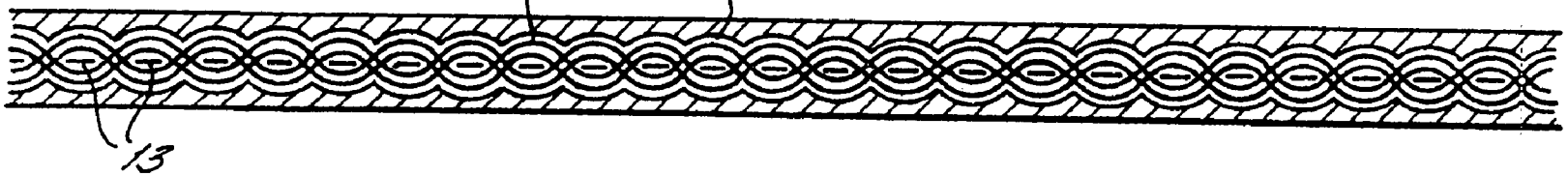
Figure 13:
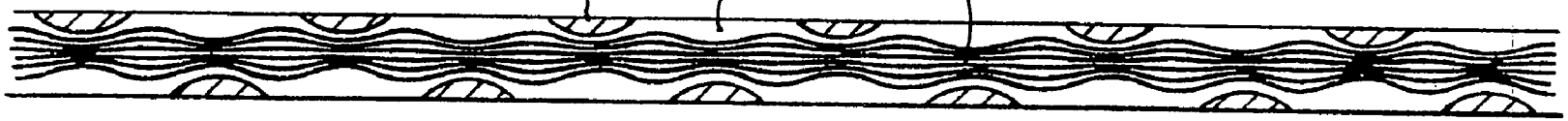
Figure 14:
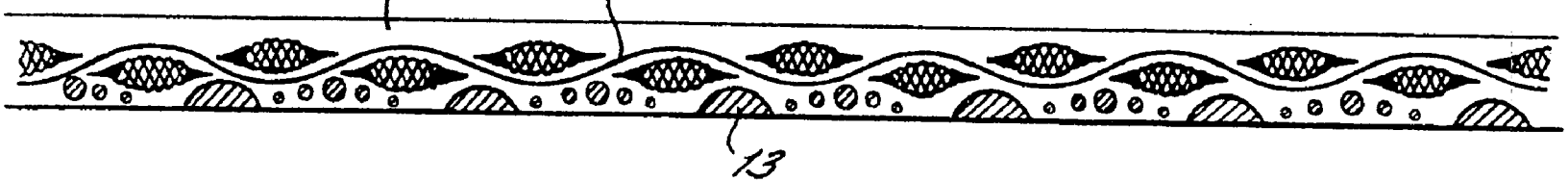
Figure 15:
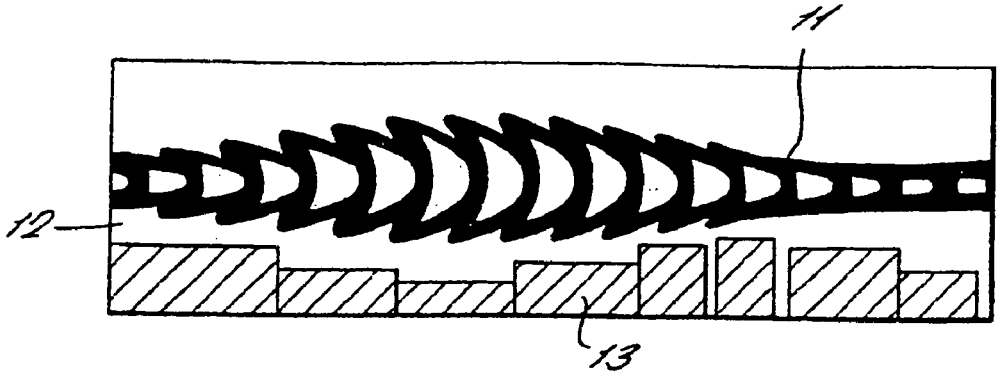
Figure 16:
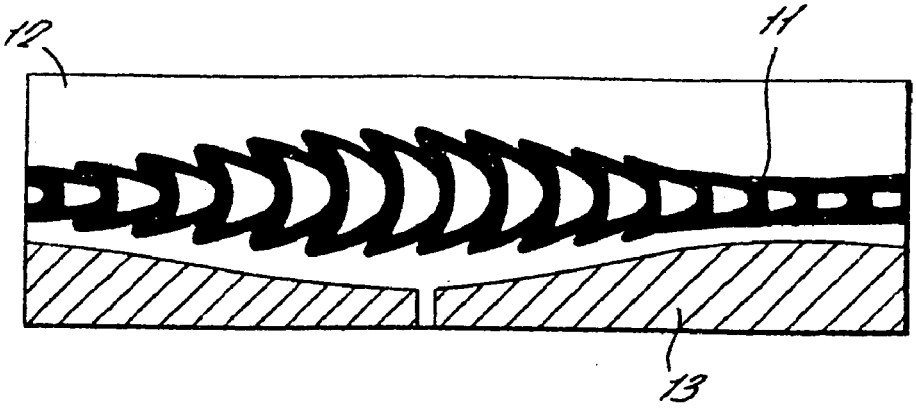
FIGS. 16-23 are enlarged segments of some of the sections of the security elements of FIGS. 10 to 15.
Figure 17:
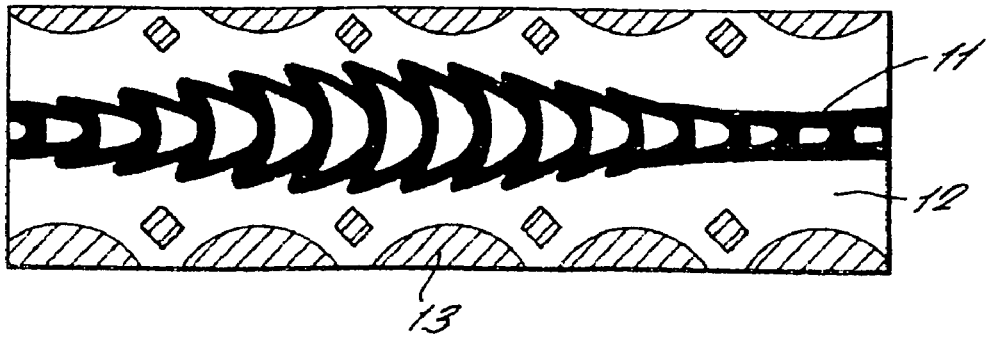
Figure 18:
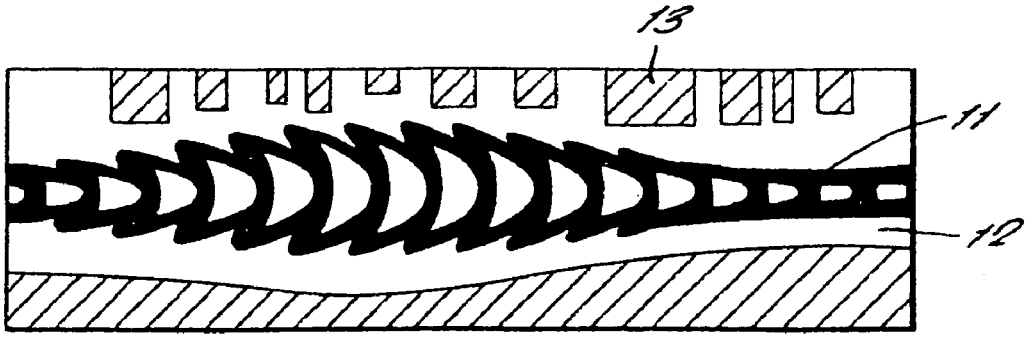
Figure 19:
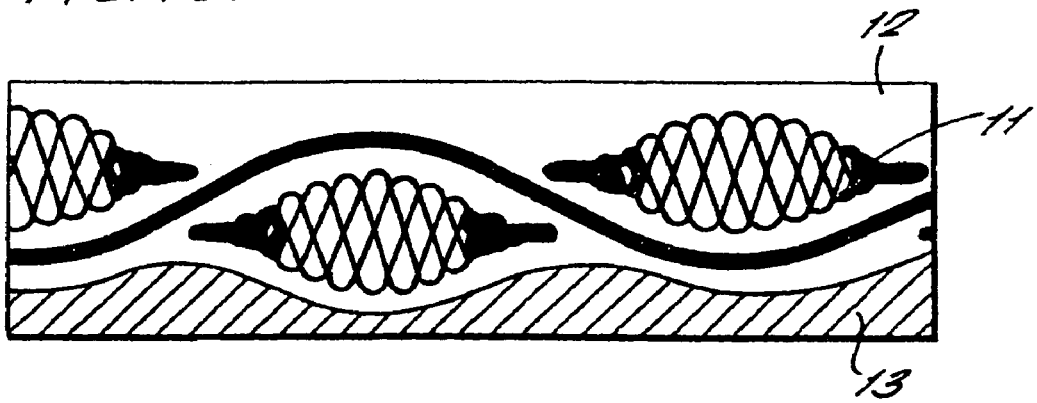
Figure 20:
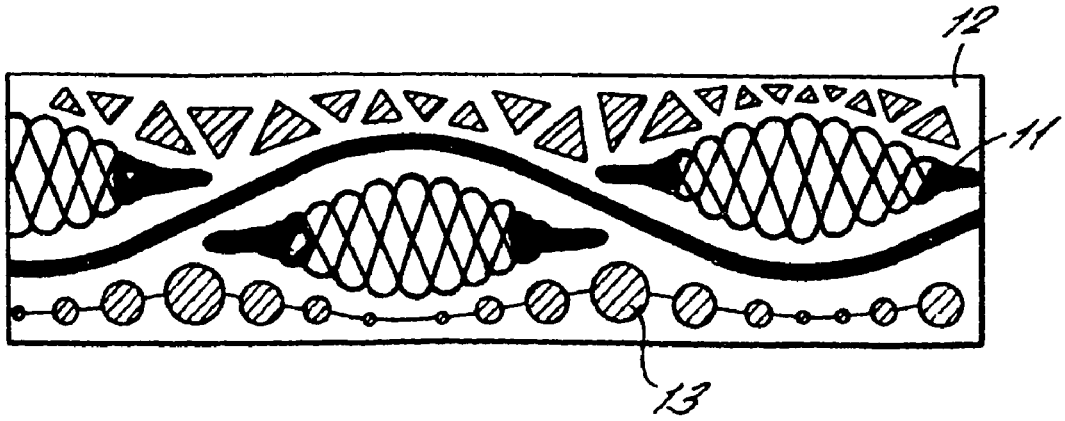
Figure 21:
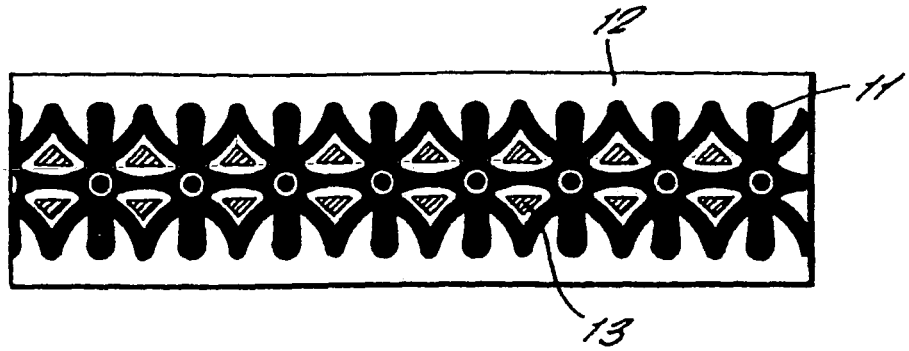
Figure 22:
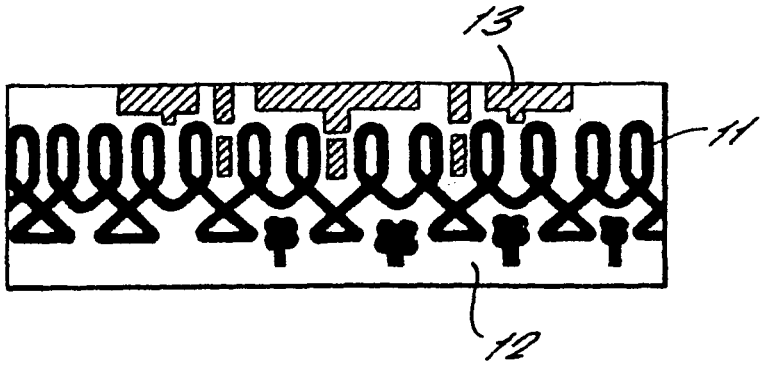
Figure 23:
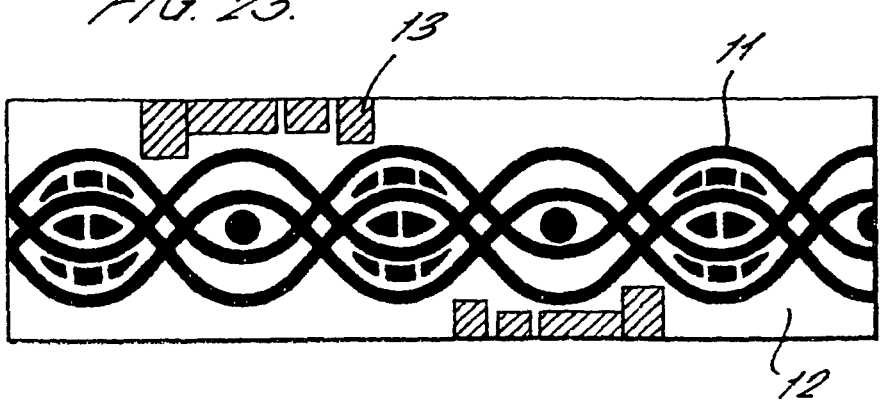

FIGS. 8 and 9 illustrate another embodiment of the security element 10 conforming to the current invention. Here the height of the indicia provided by the demetallised regions 11, and thus the maximum amplitude of the pattern, is varied in a constant and repeating manner with the magnetic feature 13 occupying areas which do not coincide with the demetallised regions 11.

The examples described thus far have focused on the combination of the magnetic feature 13 with demetallised indicia of varying position and/or height. However the current invention also lends itself particularly well to other forms of demetallised designs. FIGS. 10-24 show some alternative designs for the demetallised regions 11 and magnetic feature 13. Here the demetallised designs are based on the type of designs disclosed in EP-A-972111. EP-A-972111 describes demetallised security elements with either very fine metal or non-metal regions in regular repeating complex patterns with non-linear boundaries, of which one or more of the frequency, the instantaneous amplitude and/or the maximum amplitude of the pattern varies along the length of the element. Such designs are very much harder to replicate by counterfeiters using the techniques commonly used to mimic security elements e.g. foil blocking. In the present invention the security of the elements is further enhanced by the provision of magnetic materials. As can be seen in all the examples, the magnetic material has been provided to form a feature 13 which does not compromise the design of the demetallised regions 11 and thus their security.

To date, as the magnetic layer is hidden under an opaque metal layer and cannot be seen, no effort has been made to provide the magnetic material with any design features. The current inventors initially recognised that, with the use of magnetic viewers such as those sold by Sigma Hi-Chemical Inc under the trade name MV-95, tellers can instantly recognise the presence of magnetic materials. Thus, in the embodiments shown in FIGS. 14 and 15, the magnetic feature 13 has been printed in manner that complements the design of the demetallised regions 11. This is a unique approach and provides a convenient teller assist feature. Using one of the aforesaid detectors, the teller can easily detect the magnetic feature 13 and verify that the security document in which the security element is embedded is genuine due to the complementary nature of the demetallised regions 11 and magnetic feature 13. The security element 10 could potentially also be detected using automatic detection equipment.

Figure 4A:
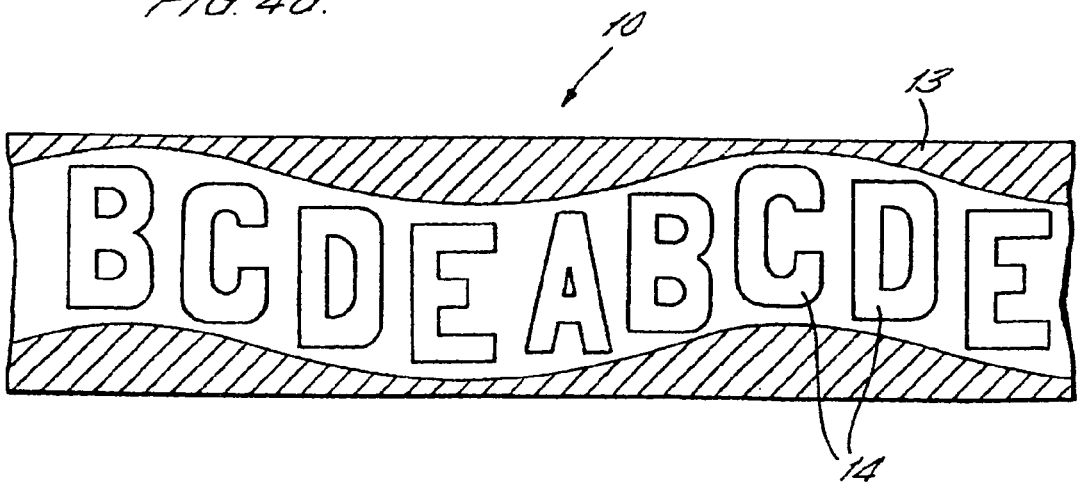

Advancing from this position, it then became apparent that, if the magnetic feature 13 was to be provided with a design complementary to that of the demetallised regions, there is no need to disguise the magnetic feature 13 by covering it with the metal layer 12. As such, in a further embodiment of the present invention shown in FIG. 4*a*, the indicia can be provided by metallic regions 14, rather than the demetallised regions 11, with no metallic layer 12. Thus the magnetic feature 13 can be seen as a dark design, which complements and contrasts with the shiny metallic indicia 14. This variation can also apply to any of the designs shown in FIGS. 5 to 15.

As a further enhancement a layer of black or coloured ink, or a series of coloured inks can be printed over the, typically dark brown, magnetic material. If a series of colours is used, these can be selected to relate to the final design of the security document which is made from the security substrate. As a further alternative, the colour can be selected to match the colour of the paper of the security substrate.

Many other materials can also be printed, or otherwise applied, over either just the magnetic feature 13 to enhance its appearance or over the whole element, such as polymer liquid crystals, thermochromics, iridescents. In the case of a liquid crystal layer, on viewing in reflected light there would be a colour shift effect where it overlies the dark magnetic feature 13, but no effect over the metallic regions 14.

The embodiment in FIG. 5 can also be further modified by using a masking coat of a similar or darker layer to disguise the magnetic code, whilst not interfering with the metallised indicia.

FIGS. 16-23 show enlarged sections of a further embodiments of security elements 10. The figures clearly show how the magnetic feature 13 has been printed in order to accommodate the demetallised regions 11.

It can be seen from the invention embodiments shown in FIGS. 4-23 that the metallic feature 13 does not extend across a full width of the security element.

Magnetic or metallic inks with different characteristics may also be used in the current invention. At least a second layer of a magnetic and/or metallic ink of differing predetermined characteristics to the first layer of magnetic and/or metallic ink, or an admixture of electro-conductive material to the magnetic material, may be applied to the security element 10 as disclosed in EP-A-0516790 or EP-A-0961996. The relative location, intensity and properties of the metallic and/or magnetic inks provide a number of coding possibilities and enhance security, but the second layer must not impair the readability of the coding of the first layer. The second layer may be applied in the form of a coding identical to the first layer, parallel or relative to it. The double coding makes it possible to perform a coincidence test wherein the coding is read independently of each other and tested for agreement.

As an alternative approach the two codes may be different and readable using a different technique or process. The second layer may be magnetic, either hard or soft, but could also be a different machine readable functional layer such as IR absorbing, or luminescent. If the second layer acts as a magnetic 'continuity' check a much smaller thickness than that required for the coding layer can be used. This means that when a sensor being used to detect coding will not receive any signal from the second magnetic layer. Since the sensors for reading magnetic coding usually require a strong signal, the magnetic material for coding must have a certain minimum thickness. However, to provide a continuity check along the length of the thread, a much thinner layer is sufficient.

In the example above two layers of differing thickness could therefore be applied—a thicker layer for coding and a thinner layer for a continuity check. The continuity layer must be sufficiently thinner than the coding layer so that a sensor being used to detect the coding receives no interference signal.

Alternatively different magnetic inks e.g. soft and hard magnetic inks could be used to distinguish between the two layers.

It is also recognised that the current invention may also be combined with other functional and feature layers, as is well known in the prior art. Other functional layers could include, but are not limited to, luminescence and IR absorbing materials. Other feature layers include, but are not limited to, photochromics, thermochromics, and optically variable layers. Examples of optically variable layers include diffractive, holographic, iridescent, pearlescent, OVI®, liquid crystal or different coloured metal layers. Though it should be appreciated that any material showing a perceptible change in appearance with change in viewing angle could be used. Where liquid crystal and iridescent or pearlescent layers are used it is preferable to use a dark background to enhance their appearance. Examples of how liquid crystal layers can be incorporated into thread constructions can be found in the applicant's copending application GB-A-0201767.

The security elements 10 of the present invention will typically be embedded either wholly or partially into a paper or polymer substrate to form a security substrate. Alternatively they may be applied in such a manner as to remain fully exposed on a surface. Where the security element 10 is to be applied to the surface of a document, instead of being embedded during manufacture, the security element 10 can be prepared as a separate foil transfer device and transferred to the document.

The resulting security substrate may be printed on one or both sides to identify the article or document. This printing may include one or more of the repeating patterns of the design on the security element itself or indeed the whole design.

The security element 10 may be used on or in bank notes, and any other security documents such as cheques, ID cards, bonds, certificates of authenticity, postal stamps, fiscal stamps, brand protection articles, security labels, vouchers and the like.

The invention claimed is:

1. A security element comprising an elongate strip of a light transmitting polymeric substrate, said substrate being provided with a magnetic feature and a metallic design, the metallic design being provided by a combination of metal and non-metallic regions which permit transmission of light and comprising indicia, characters, patterns, designs, or geometrical shapes or a combination of the aforesaid, said metallic design incorporating at least one repeating pattern of which one or more of frequency, instantaneous amplitude and maximum amplitude of the pattern varies constantly along the length of the element, a design of said magnetic feature having a varying size and shape along a length of the element and not extending across a full width of the elongated strip, said magnetic feature being positioned to not overlap with the metallic design.

2. The security element as claimed in claim 1 in which the magnetic feature comprises a continuous layer.

3. The security element as claimed in claim 1 in which the magnetic feature comprises a discontinuous layer.

4. The security element as claimed in claim 1 in which the magnetic feature comprises indicia, characters, patterns, designs or geometrical shapes.

5. The security element as claimed in claim 1 in which the magnetic feature comprises a machine readable bit pattern sequence.

6. The security element as claimed in claim 1 in which the pattern is provided by demetallised regions in a metal layer.

7. The security element as claimed in claim 6 in which the metal layer covers the magnetic feature.

8. The security element as claimed in claim 1 in which the pattern is provided by discrete metal regions.

9. The security element as claimed in claim 8 in which the magnetic feature is not covered by metal regions.

10. The security element as claimed in claim 9 in which the magnetic feature is overprinted with a black or coloured ink.

11. The security element as claimed in claim 9 in which a layer of optically variable, photochromic or thermochromic material is provided over at least the magnetic feature.

12. The security element as claimed in claim 9 in which a masking layer is provided over the magnetic feature having a colour at least as dark as that of the magnetic feature to disguise the format of the magnetic feature.

13. The security element as claimed in claim 1 in which the design of magnetic feature and the pattern of the metallic feature are complementary.

14. The security element as claimed in claim 1 in which the magnetic feature and the pattern of the metallic feature combine to comprise an authenticating feature.

15. The security element as claimed in claim 1 in which the magnetic feature has an amount of magnetic material which does not vary in any cross section of the security element.

16. The security element as claimed in claim 1 in which the magnetic feature comprises a plurality of layers of magnetic materials having differing characteristics.

17. The security element as claimed in claim 1 in which the metallic design is provided by the application of metallic ink to the substrate.

18. The security element as claimed in claim 17 in which the design is provided by a plurality of layers of metallic inks having differing characteristics.

19. The security element as claimed in claim 1 in which a layer which has a functional effect, such as luminescence or IR absorbing, is applied to the element.

20. The security substrate comprising a base substrate in which a security element according to claim 1 is at least partially embedded.

21. The security substrate comprising a base substrate to at least one surface of which a security element according to claim 1.

22. The security document made from the security substrate of claim 20.

23. The security document as claimed in claim 22, wherein at least one side thereof is printed with identifying indicia.

24. The security document as claimed in claim 23 in which the printing includes at least one of the repeating patterns of the metallic design.

25. The security document as claimed in claim 22, comprising a bank note, cheque, ID card, bond, certificate of authenticity, stamp, security label, vouchers or brand protection article.

26. A security document made from the security substrate of claim 21.

27. The security document according to claim 26, wherein at least one side thereof is printed with identifying indicia.

28. A security element comprising an elongate strip of a light transmitting polymeric substrate, said substrate being provided with a magnetic feature and a metallic design, the metallic design being provided by a combination of metal and non-metallic regions which permit the transmission of light and comprising indicia, characters, patterns, designs, or geometrical shapes or a combination of the aforesaid, said metallic design incorporating at least one repeating pattern of which one or more of the frequency, the instantaneous amplitude and/or the maximum amplitude of the pattern varies constantly along a length of the element, the design of the magnetic feature being complementary to the pattern of the metallic design and said magnetic feature being positioned to not overlap with the metallic design.

29. A security element comprising an elongate strip of a light transmitting polymeric substrate, said substrate being provided with a magnetic feature and a metallic design, the metallic design being provided by a combination of metal and non-metallic regions which permit the transmission of light and comprising indicia, characters, patterns, designs, or geometrical shapes or a combination of the aforesaid, said metallic design incorporating at least one repeating pattern of which one or more of the frequency, the instantaneous amplitude and/or the maximum amplitude of the pattern varies constantly along a length of the element, the design of the magnetic feature having a varying height, the height and design variation being such that an amount of magnetic material present in any cross section of the security element is constant and said magnetic feature being positioned to not overlap with the metallic design.

* * * * *